US005226783A

United States Patent [19]

Mita

[11] Patent Number: 5,226,783

[45] Date of Patent: Jul. 13, 1993

[54] AXIAL FLOW FAN WITH CENTRIFUGAL ELEMENTS

[75] Inventor: Yoshiyuki Mita, Shizuoka, Japan

[73] Assignee: Usui Kokusai Sangyo Kaisha Ltd., Shizuoka, Japan

[21] Appl. No.: 738,138

[22] Filed: Jul. 30, 1991

[30] Foreign Application Priority Data

Jul. 30, 1990 [JP] Japan ..... 2-199302

[51] Int. Cl.[5] ..... F04D 29/28

[52] U.S. Cl. ..... 416/223 R; 416/228

[58] Field of Search ..... 416/223 R, 169 A, 228

[56] References Cited

U.S. PATENT DOCUMENTS

| | | | |
|---|---|---|---|
| 1,041,913 | 10/1912 | Tyson | 416/228 |
| 2,104,306 | 1/1938 | McLeod | 416/228 |
| 2,710,665 | 6/1955 | Stratton | 416/228 |
| 2,957,621 | 10/1960 | Haims | 416/223 |
| 4,664,593 | 5/1987 | Hayashi et al. | 416/223 R |

FOREIGN PATENT DOCUMENTS

| | | | |
|---|---|---|---|
| 56-71921 | 6/1981 | Japan . | |
| 18596 | 1/1982 | Japan | 416/228 |
| 194689 | 11/1983 | Japan | 416/223 R |
| 8003373 | 12/1990 | Netherlands | 416/228 |
| 1486626 | 6/1989 | U.S.S.R. | 416/223 R |

*Primary Examiner*—John T. Kwon

*Attorney, Agent, or Firm*—Wenderoth, Lind & Ponack

[57] ABSTRACT

An axial flow fan has each of its fan blades provided with an integrally formed centrifugal element which extends substantially parallel to an imaginary plane containing a central axis of the fan. Some of the air flow passing through the fan collides against the centrifugal elements, which deflect the air in the radial directions. A disk-like air barrier is thus formed around the fan blades, whereby a countercurrent flow and circulation flow are eliminated. The fan efficiency is also improved.

4 Claims, 4 Drawing Sheets

AXIAL FLOW FAN WITH CENTRIFUGAL ELEMENTS

BACKGROUND OF THE INVENTION

This invention relates to an axial flow fan for an internal combustion engine, especially for an automotive engine.

In recent years, miscellaneous instruments and accessories have been equipped with an automotive engine, so that the vacant space in an engine compartment tends to become smaller. Most of the air passing through a fan flows out of the engine compartment through gaps between body frames and cover plates of a car. On the other hand, some of the air passing through the fan turns back toward the upstream side of the fan due to a turbulent flow around the tips of the fan blades. This circulation flow or countercurrent flow grows in proportion to an increase of a tip clearance, i.e., the clearance between a periphery of a cooling fan and an inner surface of a fan shroud. This circulation flow exhibits disadvantages in that the air flow is substantially reduced and the fan efficiency drops.

In Japanese Utility Model Public Disclosure No. 71921/1981 (SHO 56-71921), the above-mentioned circulation flows are illustrated. In this invention, a flange-type extension is carried at the fan shroud so as to reduce the tip clearance and to avoid the circulation flow. However, small tip clearances tend to cause collisions between the fan blade and the fan shroud.

SUMMARY OF THE INVENTION

It is an object of the present invention to provide an axial flow fan which can eliminate countercurrent flows toward the upstream side of the fan.

Another object of the present invention is to improve the fan efficiency under an actual working conditions.

According to the present invention, each fan blade of a fan is provided with an integrally formed centrifugal element which extends substantially parallel to an imaginary plane containing a central axis of the fan.

Under the specific construction of the invention, a part of the air passing through the fan blades collides against the centrifugal elements, whereby it is deflected in the radial directions. This radial air flow forms a disk-like barrier which effectively prevents passed air from moving back to the upstream side of the fan. Thus, countercurrent flows and circulation flows do not occur.

Preferably, every edge of the centrifugal elements is held within the outside diameter of the fan. Thus, the tip clearance is kept constant.

In an ordinary plastic fan, the centrifugal elements are integrally formed by a plastic moulding process. Therefore, the centrifugal elements are easy to manufacture.

Embodiments of the invention will now be described by way of example with reference to the drawings, in which like reference numerals refer to like elements in the several views.

DESCRIPTION OF THE PREFERRED EMBODIMENT

Figure 1:
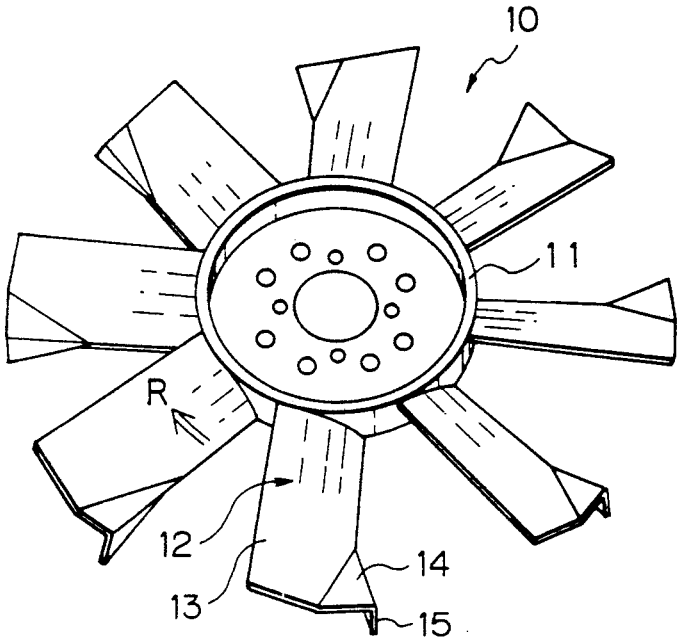
FIG. 1 is a perspective view of an axial flow fan according to a first embodiment of the present invention.
Figure 2:
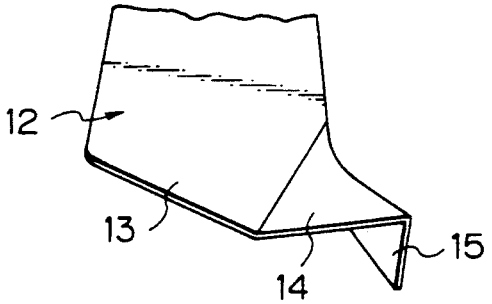
FIG. 2 is a perspective view of a distal end of the fan blade in FIG. 1.
Figure 3:
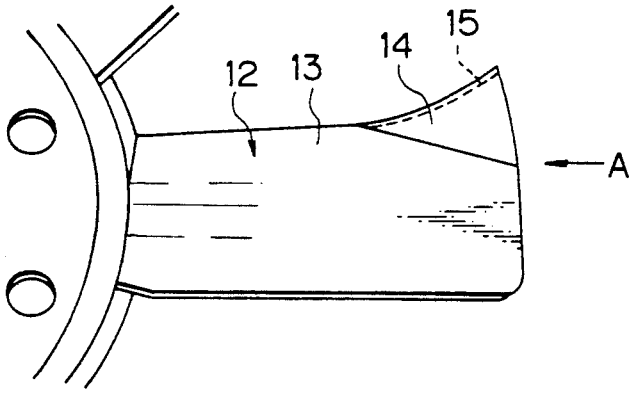
FIG. 3 is a front view of the fan blade.
Figure 4:
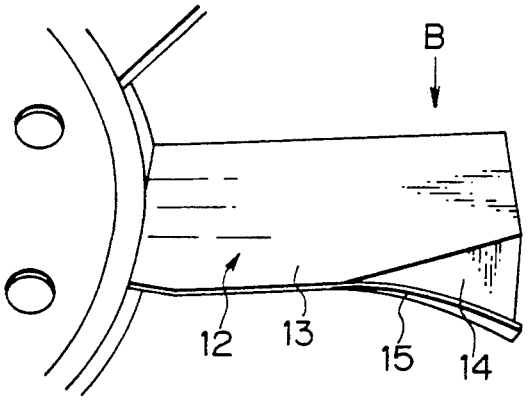
FIG. 4 is a rear view of the fan blade.
Figure 5:
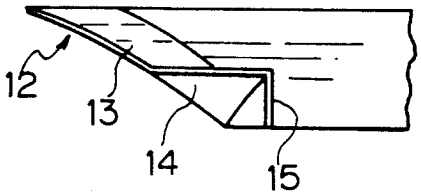
FIG. 5 is a side view seen from the arrow A in FIG. 3.
Figure 6:
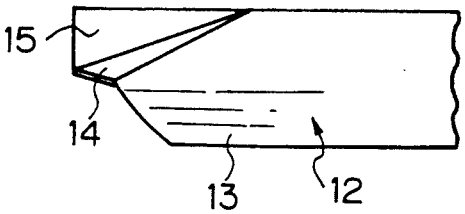
FIG. 6 is a side view seen from the arrow B in FIG. 4.

Referring to FIGS. 1 to 6, there is shown a first embodiment of the present invention. FIG. 1 shows a perspective view of a fan assembly 10.

A fan assembly 10 comprises a plastic boss 11 and eight plastic blades 12 which are circumferentially disposed at a predetermined distance from each other around the boss 11. The boss 11 and the blades 12 are integrally formed through a plastic moulding process. A body portion 13 of each fan blade 12 is formed in a twisted fashion similarly to a conventional fan blade. Near a distal end of the fan blade 12, an auxiliary triangular portion 14 and a centrifugal element 15 are integrally formed. This auxiliary portion 14 is arranged so as to connect each centrifugal element 15 and each body portion 13. The centrifugal element 15 is formed in a triangular fin shape such that one side of the triangle holds one side of the auxiliary portion 14.

The fan assembly 10 in FIG. 1 represents its surface side appearance facing a radiator. When the fan 10 rotates along the direction R in FIG. 1, cooling air is introduced from the surface side (radiator side) and is directed toward a reverse side (engine side). Accordingly, in an ordinary suction type fan, each centrifugal element 15 is disposed at the reverse side of the fan blade 12.

In FIGS. 2 to 6, there are shown several configurations of the centrifugal element 15 observed from several view angles. The centrifugal element 15 extends substantially parallel to an imaginary plane containing a central axis of the fan 10. In addition, the outside edge of the centrifugal element 15 is kept within the outside diameter of the fan 10. This means that the centrifugal element 15 does not extend over the diameter of the fan 10. Therefore, the tip clearance is kept to the same degree regardless of the centrifugal element 15.

Figure 7:
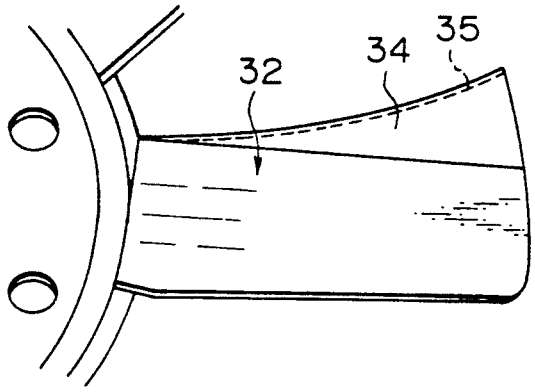
FIG. 7 is a front view of a fan blade according to a second embodiment of the invention.
Figure 8:
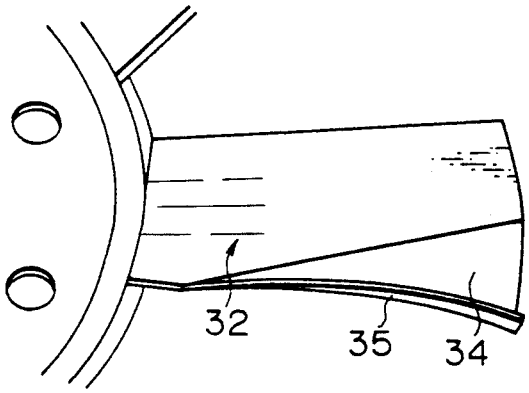
FIG. 8 is a rear view of the fan blade in FIG. 7.

FIGS. 7 and 8 illustrate a second embodiment of the invention. A centrifugal element 35 and an associated auxiliary portion 34 extend along an overall side length of the fan blade 32. This embodiment can fascilitate a plastic moulding process since the overall configuration becomes easy to manufacture.

Figure 9:
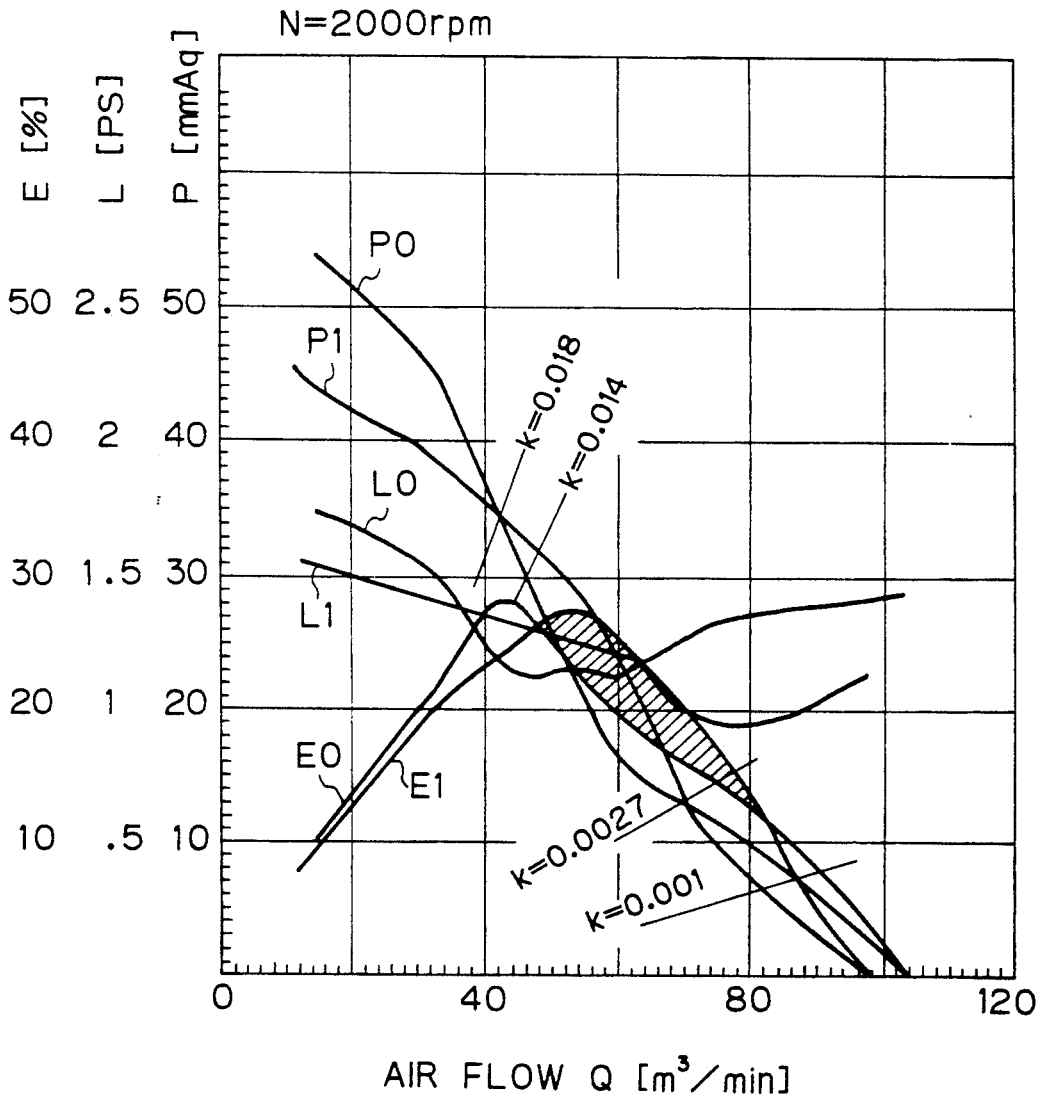
FIG. 9 is a graph showing characteristic curves of the fan having centrifugal elements.

FIG. 9 shows several characteristic curves which represent changes of three kinds of values, i.e., absorption power L, static pressure P, and fan efficiency E calculated by the following formula.

$$E = 100 \times P \times Q / 60 \times 75 \times L$$

$P$ = static pressure (mmAq) $Q$ = air flow ($m^3$/min)

$L$ = horsepower (PS)

These experimental values are plotted in relation to the volume of air flow Q. The curves P0, L0, E0 represent a case of null centrifugal element. The curves P1, L1, E1 represent a case having most efficient centrifugal elements. In addition, four resistance curves are shown in FIG. 9. These resistance curves represent resistance coefficients k of 0.001, 0.0027, 0.014 and 0.018, respectively.

In view of the fact that recent axial flow fans for automotive engines are used in a range in which the resistance coefficient k is about from 0.006 to 0.01, this range is emphasized by a cross hatching. Within this range, it is apparent that the fan efficiency E1 exceeds the fan efficiency E0.

Figure 10:
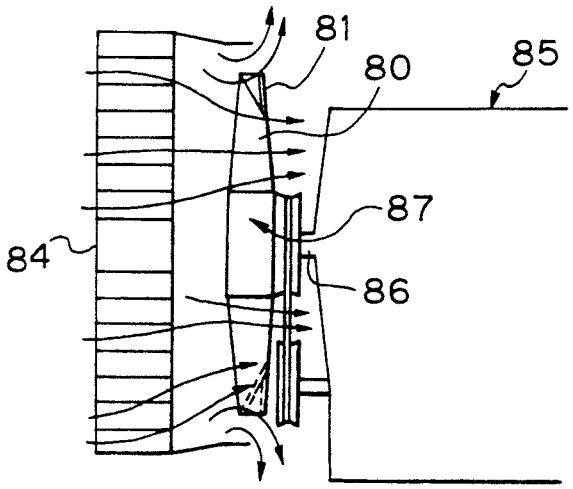
FIG. 10 is a shematic elevational view, illustrating an engine, fan, radiator and air stream lines improved by the invention.

FIG. 10 illustrates an arrangement of an engine, fan, radiator and air stream lines improved by the present invention. Some of the air streams coming from a radiator 84 collide against centrifugal elements 81 of fan blades 80, and then they are deflected in the radial directions. A disk-like air barrier is formed around tips of the fan blades 80. This air barrier prevents passed air from turning back toward the upstream side of the fan 87. Thus, countercurrent flows and circulation flows are effectively eliminated and the fan efficiency is considerably improved.

When a visco-coupling or fluid coupling is connected between a fan drive shaft 86 of an engine 85 and a fan 87, it has been believed to be difficult to reduce the tip clearance because the amplitude of vibration goes up due to the coupling. As a matter of course, the tip clearance should be large enough to avoid a collision between the tips of the fan blades and the fan shroud. However, a large tip clearance tends to cause a countercurrent flow and a circulation flow.

Particularly in such a case, the present invention can provide an effective solution to the problems. The centrifugal elements can eliminate the countercurrent flow and circulation flow without reducing the tip clearance.

It should be noted that many modifications can be applied to the configuration of the centrifugal element of the present invention.

I claim:

1. An axial flow fan for attachment to an output shaft of an internal combustion engine, comprising:

a fan boss having a central axis;

a plurality of fan blades extending radially from said fan boss and said central axis;

a plurality of centrifugal elements integrally formed with respect to said fan blades, each said centrifugal element extending substantially parallel to an imaginary plane containing said central axis; and an auxiliary triangular portion provided for each said centrifugal element, connecting the respective said centrifugal element to a respective said fan blade;

wherein each said centrifugal element is substantially triangular in shape, and one side of said centrifugal element is connected to one side of said auxiliary triangular portion.

2. The axial flow fan of claim 1, wherein:

said fan blades have an outer diameter; and each said centrifugal element extends radially within said outer diameter.

3. The axial flow fan of claim 1, wherein said fan blades have an upstream edge and a downstream edge, said centrifugal elements being disposed along said downstream edges of said fan blades.

4. The axial flow fan of claim 1, wherein each said centrifugal element extends along substantially the entire length of one side of a respective said fan blade.

* * * * *